US007793690B2

(12) United States Patent
Voglewede et al.

(10) Patent No.: US 7,793,690 B2
(45) **Date of Patent: *Sep. 14, 2010**

(54) WATER DISPENSER FOR REFRIGERATOR FREEZERS

(75) Inventors: Ronald L. Voglewede, Saint Joseph, MI (US); Kevin J. Gilboe, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/102,103

(22) Filed: Apr. 14, 2008

(65) Prior Publication Data

US 2008/0190132 A1 Aug. 14, 2008

Related U.S. Application Data

(63) Continuation of application No. 10/860,906, filed on Jun. 4, 2004, now Pat. No. 7,455,085.

(51) Int. Cl.
*B65B 1/04* (2006.01)
*B67D 7/80* (2010.01)
*F25D 25/02* (2006.01)

(52) U.S. Cl. ..... 141/362; 141/360; 222/534; 62/382

(58) Field of Classification Search ..... 141/2, 141/18, 192, 198, 360–366; 222/146.1, 534; 62/344, 377, 382
See application file for complete search history.

(56) References Cited

U.S. PATENT DOCUMENTS 1,890,461 A 12/1932 Hamburg
RE19,037 E 12/1933 West
2,020,963 A 11/1935 Reid
2,078,097 A 4/1937 Radzinsky
2,126,491 A 8/1938 Mccartha
2,229,850 A 1/1941 Hoskins ..... 62/141
2,299,103 A 10/1942 Miller et al (Continued)

FOREIGN PATENT DOCUMENTS

EP 0449061 A2 10/1991

(Continued)

OTHER PUBLICATIONS

Declaration in Patent Interference No. 105,711 filed Jul. 28, 2009, Paper No. 1, 7 pages.

(Continued)

*Primary Examiner*—Timothy L Maust

(57) ABSTRACT

A water dispenser mounted on a door of a refrigerator freezer that is provided with a spigot that is movable between inner and outer dispensing positions. The dispenser includes a dispenser housing having a dispensing cavity and the spigot is movably mounted in the top of the dispensing cavity. When the spigot is in the inner dispensing position water can be dispensed into a container positioned in the dispensing cavity. In the outer dispensing position the spigot can dispense water into a container positioned outside the dispensing cavity. The dispenser housing can be provided with a movable tray in the bottom of the dispensing cavity. The movable tray can be withdrawn to support a container under the spigot in the inner dispensing position and extended to support a container under the spigot in the outer dispensing position.

21 Claims, 8 Drawing Sheets

U.S. PATENT DOCUMENTS

| | | | | |
|---|---|---|---|---|
| 2,408,704 | A | 10/1946 | Taylor | |
| 2,462,743 | A | 2/1949 | Handel | |
| 2,504,622 | A | 4/1950 | Band et al. | |
| 2,512,395 | A | 6/1950 | Sundberg | |
| 3,406,871 | A | 10/1968 | Hoenisch | 222/56 |
| 3,429,140 | A | 2/1969 | White | |
| 3,476,295 | A | 11/1969 | Telfer | |
| 3,622,047 | A | 11/1971 | Oberli | |
| 3,747,363 | A | 7/1973 | Grimm | |
| 3,759,053 | A | 9/1973 | Swaneck, Jr. | 62/157 |
| 3,851,939 | A | 12/1974 | Benasutti | |
| 4,076,349 | A | 2/1978 | Gettleman et al. | |
| 4,090,641 | A | 5/1978 | Lindenschmidt | 222/504 |
| 4,209,999 | A | 7/1980 | Falk et al. | |
| 4,227,383 | A | 10/1980 | Horvay | |
| 4,252,002 | A | 2/1981 | Mullins, Jr. | |
| 4,284,212 | A | 8/1981 | Caswell | |
| 4,462,437 | A | 7/1984 | Prada | |
| 4,739,629 | A | 4/1988 | True | |
| 4,800,935 | A | 1/1989 | Buchser et al. | 141/362 |
| 4,981,237 | A | 1/1991 | Landers | 222/1 |
| 5,112,477 | A | 5/1992 | Hamlin | |
| 5,209,082 | A | 5/1993 | Ha | |
| 5,269,154 | A | 12/1993 | Schmidt | |
| 5,273,219 | A | 12/1993 | Beach, Jr. et al. | |
| 5,279,001 | A | 1/1994 | Vento | 4/447 |
| 5,297,400 | A | 3/1994 | Benton et al. | |
| 5,437,391 | A | 8/1995 | Landers et al. | |
| 5,490,547 | A | 2/1996 | Abadi et al. | |
| 5,526,854 | A | 6/1996 | Unger | |
| 5,542,265 | A | 8/1996 | Rutland | |
| 5,603,230 | A | 2/1997 | Tsai | |
| 5,683,015 | A | 11/1997 | Lee | |
| 5,797,524 | A | 8/1998 | Lentz | |
| 5,956,967 | A | 9/1999 | Kim | |
| 6,050,097 | A | 4/2000 | Nelson et al. | |
| 6,082,130 | A | 7/2000 | Pastryk et al. | |
| 6,101,835 | A | 8/2000 | Butsch et al. | |
| 6,135,173 | A | 10/2000 | Lee et al. | |
| 6,148,624 | A | 11/2000 | Bishop et al. | |
| 6,158,564 | A | 12/2000 | Derelanko | |
| 6,220,313 | B1 | 4/2001 | Estlander | |
| 6,286,324 | B1 | 9/2001 | Pastryk et al. | |
| 6,314,745 | B1 | 11/2001 | Janke et al. | |
| 6,351,958 | B1 | 3/2002 | Pastryk et al. | |
| 6,595,021 | B2 | 7/2003 | Skinner | |
| 6,648,187 | B1 | 11/2003 | Shypkowski | |
| 6,651,449 | B2 | 11/2003 | Heims et al. | |
| 6,679,082 | B1 | 1/2004 | Tunzi | |
| 7,007,500 | B2 | 3/2006 | Lee | |
| 7,059,693 | B2 | 6/2006 | Park | |
| 7,108,342 | B2 | 9/2006 | Shin et al. | |
| 7,207,189 | B2 | 4/2007 | An et al. | |
| 7,316,121 | B2 | 1/2008 | Lee et al. | |
| 7,383,689 | B2 | 6/2008 | Lee et al. | 62/98 |
| 2001/0030201 | A1 | 10/2001 | Gerhardt | |

FOREIGN PATENT DOCUMENTS

| | | |
|---|---|---|
| JP | 50-69644 | 6/1975 |
| JP | 51-4116 | 1/1976 |
| JP | 51-021164 | 2/1976 |
| JP | 58-74086 | 5/1983 |
| JP | 4-013072 | 1/1992 |
| JP | 9-120482 | 5/1997 |
| JP | 2002-115960 | 4/2002 |
| JP | 2003054697 | 2/2003 |
| KR | 200133327 | 10/1998 |
| KR | 19990043740 | 6/1999 |
| KR | 20010005331 | 1/2001 |
| KR | 200267237 | 3/2002 |
| WO | 99/24351 A1 | 5/1999 |
| WO | 2007/011304 A1 | 1/2007 |

OTHER PUBLICATIONS

Voglewede Notice of Related Proceedings in Patent Interference No. 105,711 filed Aug. 11, 2009, Paper No. 6, 3 pages.

Lee Notice of Related Proceedings in Patent Interference No. 105,711 filed Aug. 11, 2009, Paper 10, 3 pages.

Re-Declaration in Patent Interference No. 105,711 filed Sep. 14, 2009, Paper No. 21, 5 pages.

Lee Motion 2 (To Undesignate Claims) in Patent Interference No. 105,711 filed Nov. 6, 2009, Paper No. 30, 33 pages.

Lee Motion No. 3 (For Judgment under 35 U.S.C. § 102) in Patent Interference No. 105,711 filed Nov. 6, 2009, Paper No. 38, 37 pages.

Voglewede Opposition 2 in Patent Interference No. 105,711 filed Jan. 11, 2010, Paper No. 46, 44 pages.

Voglewede Opposition 3 in Patent Interference No. 105,711 filed Jan. 11, 2010, Paper No. 47, 42 pages.

Lee Reply 2 in Patent Interference No. 105,711 filed Mar. 1, 2010, Paper 54, 44 pages.

Lee Reply 3 in Patent Interference No. 105,711 filed Mar. 1, 2010, Paper 55, 38 pages.

Voglewede Revised Observations on Cross-Examination of Lee Witness Warren F. Bessler in Patent Interference No. 105,711 filed May 5, 2010, Paper No. 69, 7 pages.

Lee Responses to Voglewede's Revised Observations in Patent Interference No. 105,711 filed May 7, 2010, Paper No. 70, 7 pages.

Voglewede Supplemental Notice of Related Proceedings in Patent Interference No. 105,711 filed May 17, 2010, Paper No. 172, 3 pages.

Exhibit 1017 - Declaration of Warren F. Bessler in Support of Lee Motion 2 to Undesignate Claims in Patent Interference No. 105,711 filed May 17, 2010, Document No. 90, 14 pages.

Exhibit 1022 - Video Deposition of Smith-Dahmer by (Ann Dahmer) in Patent Interference No. 105,711 filed May 17, 2010, Document No. 95, 22 pages.

Exhibit 1023 - 30(B) Videotaped Deposition of Whirlpool (Gregory R. Garavalia) Friday, Jul. 24, 2009, Chicago, Illinois in Patent Interference No. 105,711 filed May 17, 2010, Document No. 96, 128 pages.

Exhibit 1024 - 30(b)(6) Deposition of Whirlpool by Ronald L. Voglewede Jul. 28, 2009, Chicago, Illinois in Patent Interference No. 105,711 filed May 17, 2010, Document No. 97, 157 pages.

Exhibit 1025 - Master Services Agreement between Whirlpool Corporation and Smith-Dahmer Associates, LLC effective Apr. 1, 2002, filed in Patent Interference No. 105,711 on May 17, 2010, Document No. 98, 74 pages.

Exhibit 1026 - Email communication dated May 19, 2003, filed in Patent Interference No. 105,711 on May 17, 2010, Document No. 99, 8 pages.

Exhibit 1027 - Discussion Guide - Refrigeration Doors and Dispensers, dated Jun. 2003, filed in Patent Interference No. 105,711 on May 17, 2010, Document No. 100, 6 pages.

Exhibit 1028 - Smith-Dahmer Description of Consumer Groups filed in Patent Interference No. 105,711 filed May 17, 2010, Document 101, 77 pages.

Exhibit 1029 - Whirlpool Description of Smith-Dahmer 2003 Marketing Research filed in Patent Interference No. 105,711 filed May 17, 2010, Document No. 102, 1 page.

Exhibit 1032 - Deposition of Gregory G. Hortin, Jul. 28, 2009, Chicago, Illinois, filed in Patent Interference No. 105,711 on May 17, 2010, Document No. 105, 103 pages.

Exhibit 1033 - CT&ED Monthly Report, Refrigeration & Air Treatment Products, Apr. 2003 Working Document, filed in Patent Interference No. 105,711 May 17, 2010, Document No. 106, 23 pages.

Exhibit 1034 - Telephonic Judge's Conference Before The Honorable Jameson Lee Sep. 15, 2009 filed in Patent Interference No. 105,711 on May 17, 2010, Document No. 107, 31 pages.

Exhibit 1036 - 30(b)(6) Depositionof Whirlpool by Ronald L. Voglewede Sep. 1, 2009 Chicago, Illinois, filed in Patent Interference No. 105,711 May 17, 2010, Document No. 109, 94 pages.

Exhibit 1037 - Advanced Dispenser CDT TDP Presentation dated Jun. 25, 2003 filed in Patent Interference No. 105,711 May 17, 2010, Document No. 110, 43 pages.
Exhibit 1039 Cirriculum Vitae of Gary T. Ford filed in Patent Interference No. 105,711 May 17, 2010, Document No. 112, 12 pages.
Exhibit 1040 Decaration of Gary T. Ford in Support of Lee Motion 3 filed in Patent Interference No. 105,711 May 17, 2010, Document No. 113, 9 pages.
Exhibit 1062 - Oral Videotaped Deposition Albert V. Karvelis, Ph.D., P.E., Feb. 17, 2010, filed in Patent Interference No. 105,711 May 17, 2010, Document No. 134, 51 pages.
Exhibit 1065 - Supplemental Declaration of Warren F. Bessler i nSupport of Lee Motion 2 (To Undesignate Claims) filed in Patent Interference No. 105,711 May 17, 2010, Document No. 137, 12 pages.
Exhibit 2014 - Videotaped Deposition of Warren F. Bessler, Ph.D., Washington, D.C., Dec. 15, 2009, filed in Patent Interference No. 105,711 May 17, 2010, Document No. 156, 78 pages.
Exhibit 2015 - Declaration of Albert V. Karvelis filed in Patent Interference No. 105,711 May 17, 2010, Document No. 157, 10 pages.
Exhibit 2019 - Videotaped Deposition of Gary T. Ford, Dec. 23, 2009, filed in Patent Interference No. 105,711 May 17, 2010, Document No. 161, 42 pages.
Exhibit 2021 - Videotaped Deposition of Warren F. Bessler, Ph.D., Wachington, D.C., Mar. 23, 2010, filed in Patent Interference No. 105,711 May 17, 2010, Document No. 163, 99 pages.
Suggestion for Interferance Under 37 C.F.R. 41.202 filed in U.S. Appl No. 12/339,424 on Dec. 19, 2008, 33 pages.
Exhibit 1 to Suggestion for Interferance Under 37 C.F.R. 41.202 filed in U.S. Appl. No. 12/339,424 on Dec. 19, 2008, 57 pages.
Exhibit 2 to Suggestion for Interferance Under 37 C.F.R. 41.202 filed in U.S. Appl. No. 12/339,424 on Dec. 19, 2008, 41 pages.
Exhibit 3 to Suggestion for Interferance Under 37 C.F.R. 41.202 filed in U.S. Appl. No. 12/339,424 on Dec. 19, 2008, 105 pages.
Exhibit 4 to Suggestion for Interferance Under 37 C.F.R. 41.202 filed in U.S. Appl. No. 12/339,424 on Dec. 19, 2008, 84 pages.
Exhibit 5 to Suggestion for Interferance Under 37 C.F.R. 41.202 filed in U.S. Appl. No. 12/339,424 on Dec. 19, 2008, 13 pages.
Exhibit 6 to Suggestion for Interferance Under 37 C.F.R. 41.202 filed in U.S. Appl. No. 12/339,424 on Dec. 19, 2008, 11 pages.
Exhibit 7 to Suggestion for Interferance Under 37 C.F.R. 41.202 filed in U.S. Appl. No. 12/339,424 on Dec. 19, 2008, 51 pages.
Exhibit 8 to Suggestion for Interferance Under 37 C.F.R. 41.202 filed in U.S. Appl. No. 12/339,424 on Dec. 19, 2008, 38 pages.
Exhibit 9 to Suggestion for Interferance Under 37 C.F.R. 41.202 filed in U.S. Appl. No. 12/339,424 on Dec. 19, 2008, 14 pages.
Exhibit 10 to Suggestion for Interferance Under 37 C.F.R. 41.202 filed in U.S. Appl. No. 12/339,424 on Dec. 19, 2008, 79 pages.
Exhibit 11 to Suggestion for Interferance Under 37 C.F.R. 41.202 filed in U.S. Appl. No. 12/339,424 on Dec. 19, 2008, 9 pages.
Supplemental Suggestion for Interferance Under 37 C.F.R. 41.202 filed in U.S. Appl. No. 12/339,424 on Jun. 1, 2009, 30 pages.
Lee List of Proposed Motions in Patent Interference No. 105,711 filed Sep. 9, 2009, Paper No. 19, 4 pages.
Voglewede List of Proposed Motions in Patent Interference No. 105,711 filed Sep. 9, 2009, Paper No. 20, 11 pages.
Order Authorizing Motions in Patent Interference No. 105,711 filed Sep. 16, 2009, Paper No. 22, 6 pages.
Amana Brochure entitled "The Many Sides of Amana - Introducing the New 2002 Amana Side-By- Side Family of Regrigerators", by Amana, 20 page, 2001 Copyright.

WATER DISPENSER FOR REFRIGERATOR FREEZERS

CROSS-REFERENCE TO RELATED APPLICATIONS

This application is a continuation of prior application Ser. No. 10/860,906, filed Jun. 4, 2004, which application is hereby incorporated by reference. This application is also related to a division of prior application Ser. No. 10/860,906, filed Jun. 4, 2004, filed concurrently herewith as patent application US20030308-2.

BACKGROUND OF THE INVENTION

1. Field of the Invention

The present invention relates to water dispensers that can be located on the outer surface of a refrigerator door.

2. Description of the Related Art

Ice and water dispensers are known for use in household refrigerator freezers. Water dispensers that include a movable spout that can be associated with a movable closure or door are also known.

SUMMARY OF THE INVENTION

The present invention is directed to a water dispenser for a refrigerator freezer that has a dispenser housing mounted on a door of the refrigerator. The dispenser housing includes a dispensing cavity that includes a spigot. The spigot is movably mounted for movement between an inner dispensing position in the dispensing cavity and an outer dispensing position in front of the dispensing cavity.

The movably mounted spigot according to the invention can be movable to one or more dispensing positions between the inner dispensing position and the outer dispensing position.

The movably mounted spigot according to the invention can be rotatably mounted in the upper portion of the dispensing cavity.

The movably mounted spigot according to the invention can be pivotally mounted in the upper portion of the dispensing cavity.

The movably mounted spigot according to the invention can be slideably mounted in the upper portion of the dispensing cavity.

DESCRIPTION OF THE INVENTION

The use of refrigerator water dispensers has changed with the advent of the addition of water filters to refrigerators for filtering the water dispensed through an ice and water dispenser. Such water filters are known to improve the taste and appearance of water for user consumption. Consumers are now using filtered water from the refrigerator water dispenser instead of using sink mounted or countertop water filtration systems. Accordingly, consumers are requiring more flexibility and features from their refrigerator water dispenser. Uses for water dispensers now include filling of large containers for cooking and consumption. The result of the new uses for refrigerator water dispensers is the need for new ways to fill larger containers. This can be accomplished by providing a spigot that is movable from a home position to a fully extend position that can extend 1" to 6" toward the user. This can also be accomplished by providing a water wand accessed from the water dispenser housing and having extendable tubing to allow filling of containers on an adjacent countertop or items on the floor such as a pet water dish or a large cooler. While the water dispenser according to the invention is disclosed as part of an ice and water dispenser for a refrigerator freezer, those skilled in the art should understand that the water dispenser according to the invention can be used as a water dispenser only, and not combined with an ice dispenser. Accordingly, the water dispenser according to the invention will be referred to as a water dispenser with the understanding that water dispenser is to be understood as referring to both a water dispenser and an ice and water dispenser. The water dispenser according to the invention can be used with a measured fill water dispenser as disclosed in U.S. patent application Ser. No. 10/861,203 filed concurrently with the parent of this application, now U.S. Pat. No. 7,201,005, which patent application is incorporated by reference. The water dispenser according to the invention can be used with a variable flow rate water dispenser disclosed in U.S. patent application Ser. No. 10/861,569, filed concurrently with the parent of this application, now U.S. Pat. No. 7,210,601, which patent application is incorporated by reference.

Figure 1:
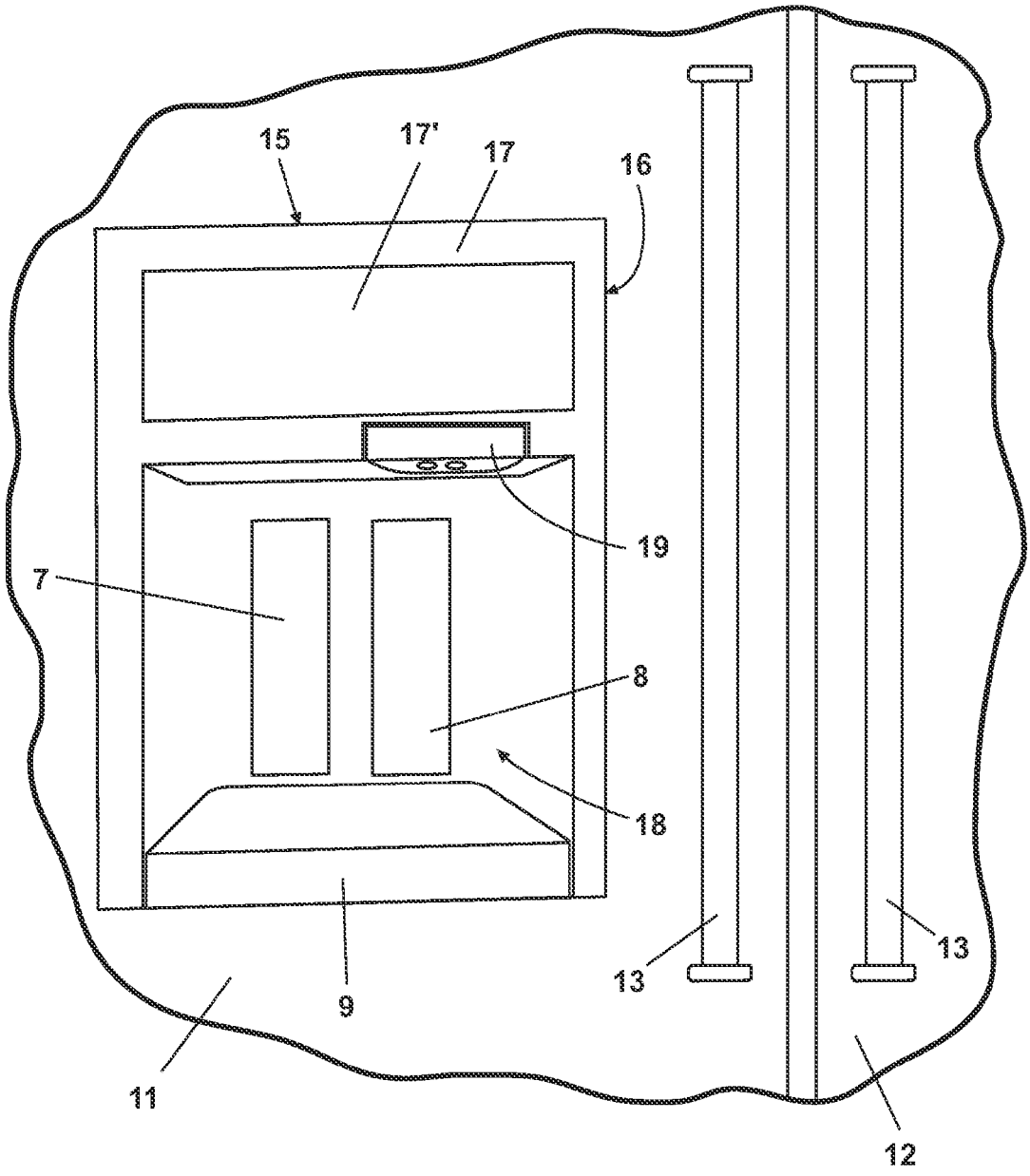
FIG. 1 is a partial front view of a refrigerator freezer having an ice and water dispenser according to the invention.
Figure 2:
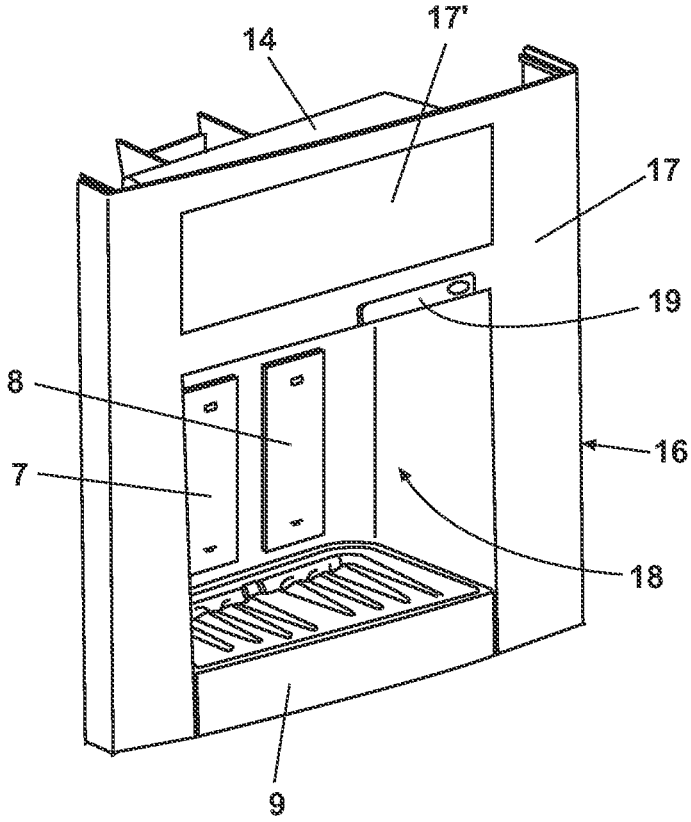
FIG. 2 is a perspective view showing an ice and water dispenser housing according to the invention removed from the refrigerator freezer.
Figure 3:
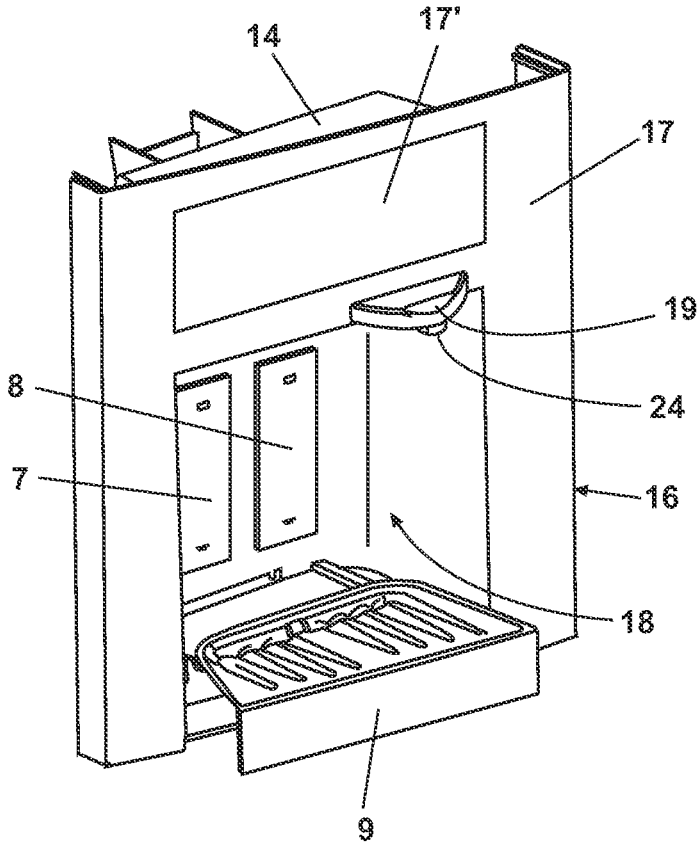
FIG. 3 is a perspective view showing the ice and water dispenser housing of FIG. 2 showing the container tray extended.
Figure 4:
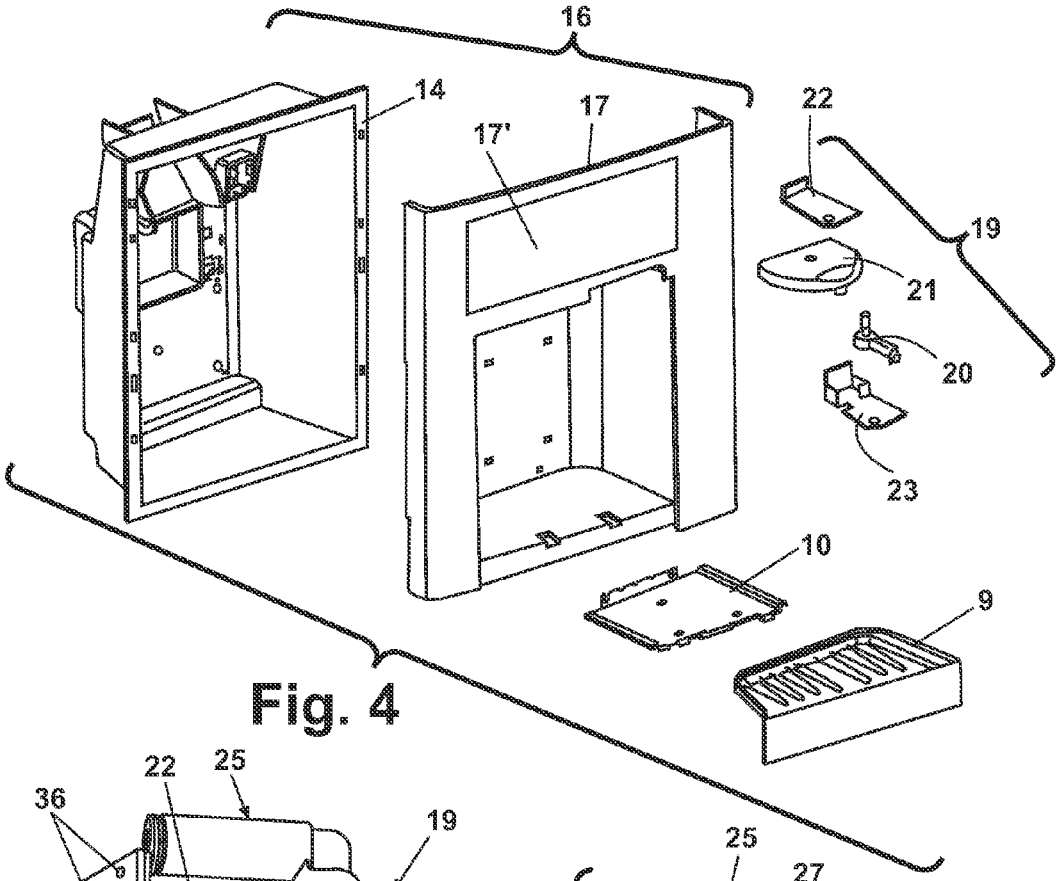
FIG. 4 is an exploded perspective view of the ice and water dispenser housing of FIG. 2.

Turning to FIG. 1, FIG. 2, FIG. 3 and FIG. 4, a water dispenser 15 is shown on the freezer door 11 of a side by side refrigerator freezer. The refrigerator freezer can also have a refrigerator door 12. The freezer door 11 and refrigerator door 12 can have handles 13. While water dispenser 15 is shown on a side by side refrigerator freezer those skilled in the art will understand that the water dispenser can be used in conjunction with any refrigerator configuration, all refrigerator, top freezer, bottom freezer and side by side and can be positioned on either the freezer compartment door or the refrigerator compartment door. Water dispenser 15 can include a dispenser housing 16 mounted in the face of freezer door 11. Dispenser housing 16 can include a dispenser enclosure 14 arranged to be mounted in freezer door 11 and a bezel 17. Bezel 17 can accommodate a water dispenser control and a user interface, not shown, that can be located at 17' all as described in U.S. patent application Ser. No. 10/861,203, now U.S. Pat. No. 7,201,005, referred to above. Bezel 17 or dispenser enclosure 14 can include a dispensing cavity 18 arranged to accommodate glasses and the like on a tray 9. Paddles 7 and 8 can be provided in the dispensing cavity 18 for actuating ice and water dispensing mechanisms respectively. According to the invention, a movable spigot 19 can be provided for the water dispenser. Spigot 19 is shown in a home or inner dispensing position in FIG. 1 and FIG. 2 and in an extended or outer dispensing position in FIG. 3. Tray 9 can be movably mounted to dispenser housing 16 for movement between withdrawn position in the dispensing cavity 18, as shown in FIG. 1 and FIG. 2, and an extended position as shown in FIG. 3 for supporting containers too large to be accommodated in dispensing cavity 18. As shown in FIG. 4, tray 9 can be slidably mounted on a track 10 that can be mounted to bezel 17 or dispenser enclosure 14.

Figure 6:
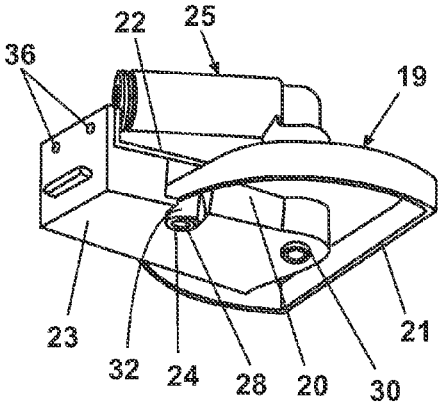
FIG. 6 is a rear perspective view of the water spout assembly removed from the ice and water dispenser of FIG. 2.
Figure 5:
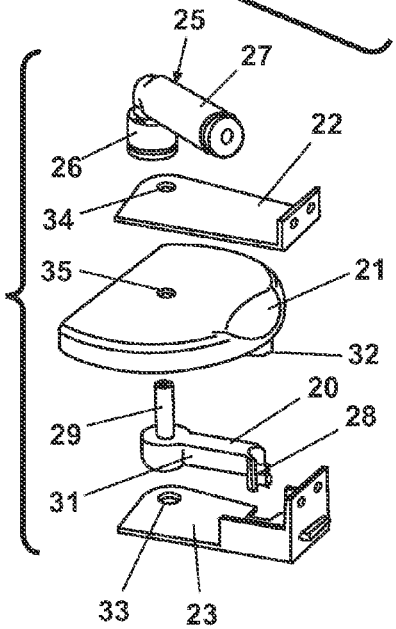
FIG. 5 is an exploded perspective view of the water spout assembly from the ice and water dispenser of FIG. 2.

Turning to FIG. 4, FIG. 5 and FIG. 6, movable spigot 19 can be seen. Spigot 19 can be movably mounted to bezel 17 or dispenser enclosure 14 for movement between an inner dispensing position (FIG. 1 and FIG. 6) and an outer dispensing position (FIG. 3). Spigot 19 can include a spigot body 20 that can include an enlarged channel 31 leading from a pivot end 29 to flow straightening vanes 28. Spigot shroud 21 can include a semi-cylindrical wall 32 that can enclose flow straightening vanes 28 to form a fluid enclosure that can form nozzle 24. In lieu of, or in addition to flow straightening vanes 28, the spigot can include a screen, not shown, or an aerator, not shown, to provide laminar or aerated flow of water from spigot 19.

Spigot body 20 and a spigot shroud 21 can be held together and supported on bezel 17 by upper bracket 22 and lower bracket 23. Spigot body 20 can include a mounting pin 30 that can be received in an opening 33 in lower bracket 23. Pivot end 29 of spigot body 20 can pass through an opening 35 in spigot shroud 21 and an opening 34 in upper bracket 22. Thus, spigot 19 can be held together by upper bracket 22 and lower bracket 23 when the brackets are mounted in bezel 17 or dispenser enclosure 14 with fasteners, not shown, that can pass through mounting holes 36. Pivot end 29 can be connected to the water system in the refrigerator, not shown, via conduit assembly 25. Conduit assembly 25 can include a swivel interface arranged to be positioned on pivot end 29 to make a rotatable watertight connection with spigot body 20. Conduit assembly 25 can also include a check valve, not shown, in body 27 to prevent drips of water from nozzle 24 by preventing small forward and backward oscillations of water in the direction of water flow when the valve controlling flow to nozzle 24 is closed. Thus, spigot 19 can be rotated from the inner dispensing position, as shown in FIG. 1 and FIG. 2, to the outer dispensing position, as shown in FIG. 3 by rotating spigot 19 counter clockwise. Since the pivot point for spigot 19, formed by pivot end 29 and mounting pin 30 is adjacent the exterior surface of dispensing cavity 18, when spigot 19 is rotated 180°, nozzle 24 can move from an inner dispensing position in the dispensing cavity 18 (see FIG. 6) to an outer dispensing position in front of dispensing cavity 18 (see FIG. 3). In this embodiment the distance between mounting pin 30 and nozzle 24 can be ¼" to 2½ that can allow nozzle 24 to extend 1" to 2¼" beyond the face of bezel 17 to facilitate filling of large containers. Those skilled in the art will understand that the dimensions of movable spigot 19 can be adjusted to satisfy a trade-off of the depth dispensing cavity 18 with desired extension of spigot 19 beyond the face of bezel 17.

Concurrently with rotating spigot 19 from its inner to its extended position, tray 9 can be slid outwardly on track 10 to an extended position to support a container to be filled under extended nozzle 24. It is to be understood that while tray 9 can be drawn out to its extended position when spigot 19 is rotated to its outer dispensing position, tray 9 can be left withdrawn in dispensing cavity 18 when the user desires to fill a container too large to be positioned between nozzle 24 and tray 9 when they are both extended. While spigot 19 is shown in two positions in the embodiment of the invention shown in FIG. 1 through FIG. 6, spigot 19 can be provided with one or more detent stops between the inner and outer dispensing positions. Similarly, while spigot 19 can be manually movable between the inner and outer dispensing positions in the embodiment of FIG. 1 through FIG. 6, those skilled in the art will understand that spigot 19 can be provided with a drive mechanism, not shown, that can include a stepper motor to drive the spigot between its inner and extended positions, and one or more intermediate positions. Likewise, tray 9 can be provided with a drive mechanism, not shown, to drive tray 9 between its inner and extended positions in conjunction with, or independently of spigot 19. Those skilled in the art will understand that the controls as described in U.S. patent application Ser. No. 10/861,203, now U.S. Pat. No. 7,201,005, referred to above can be arranged to include a control, not shown, to operate a spigot drive mechanism and/or a tray drive mechanism. Further, an actuator(s), not shown, can be provided on user interface 17' that can be connected to the control, not shown, to allow a user to operate the spigot drive and/or tray drive by operating the actuator(s).

Figure 7:
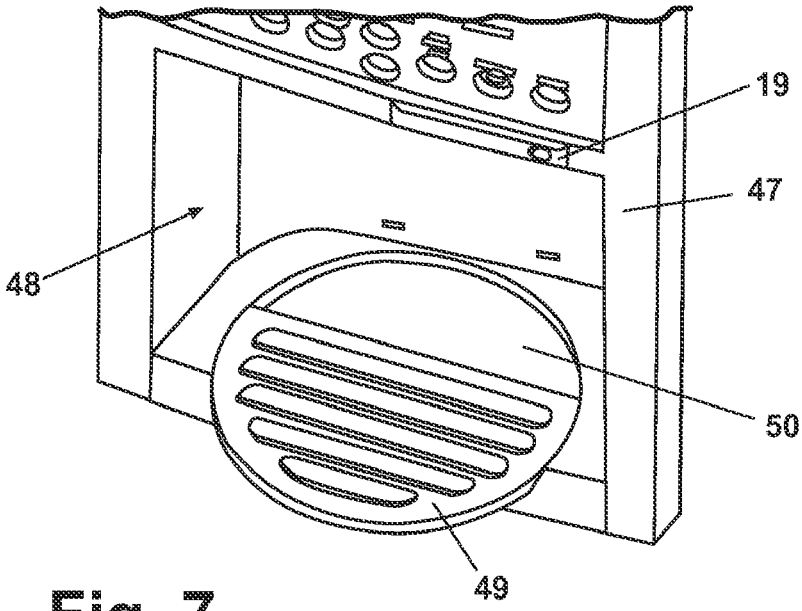
FIG. 7 is a partial perspective view of another embodiment of an ice and water dispenser according to the invention removed from a refrigerator freezer.

Turning to FIG. 7 a rotatable tray embodiment of the invention can be seen. Bezel 47 or dispenser enclosure 48 can rotatably support a tray 49 in a recess 50 in the bottom wall of dispenser enclosure 48. Bezel 47 can include a rotatable spigot 19 like the spigot in the embodiment of FIG. 1 through FIG. 6. In the embodiment of FIG. 7, tray 49 can be rotated 180° between the extended position shown into recess 50 so that tray 49 does not extend beyond the face of bezel 47, not shown. Those skilled in the art will understand that tray 49 can be provided with a drive mechanism to drive tray 49 between the inner and extended positions.

Figure 8:
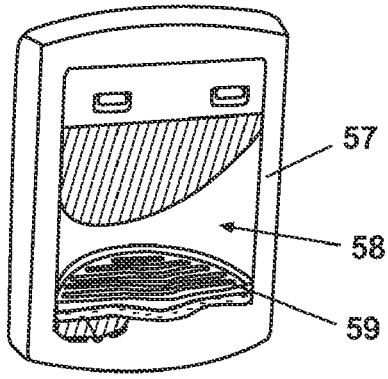
FIG. 8 is a partial perspective view of another embodiment of an ice and water dispenser according to the invention removed from a refrigerator freezer.
Figure 9:
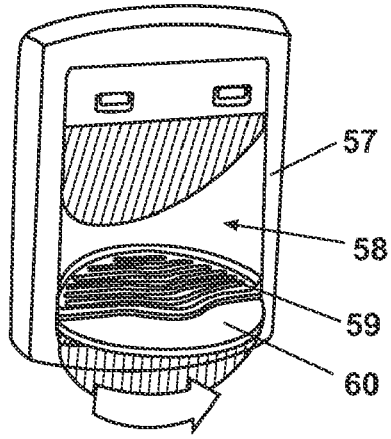
FIG. 9 is a partial perspective view of the ice and water dispenser of FIG. 8 with the tray fully rotated to an extended position.
Figure 8A:
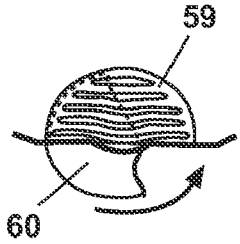
FIG. 8A is a partial top view showing the container tray of the ice and water dispenser of FIG. 8 partially rotated to an extended position.

Turning FIG. 8, FIG. 8A and FIG. 9 another rotatable tray embodiment of the invention can be seen. Dispenser housing 58 can have a bottom wall 59 that can form a fixed tray portion. A rotatable tray portion 60 can be rotatably supported under bottom wall 59 for movement between withdrawn and extended positions (see FIG. 8 and FIG. 9). As shown in FIG. 8 A, rotatable tray portion 60 can rotate in the counterclockwise direction between its withdrawn position and its extended position. As in the case of the prior embodiments, the rotatable tray portion 60 can be manually movable between the withdrawn and extended positions. Those skilled in the art will understand that rotatable tray portion can be provided with a drive mechanism to drive the movable tray portion between the withdrawn and extended positions. Further, while a movable spigot is not shown in FIG. 8, FIG. 8A and FIG. 9 those skilled in the art will understand that bezel 57 can have a movable spigot as disclosed in one of the several movable spigot embodiments of the invention.

Figure 10:
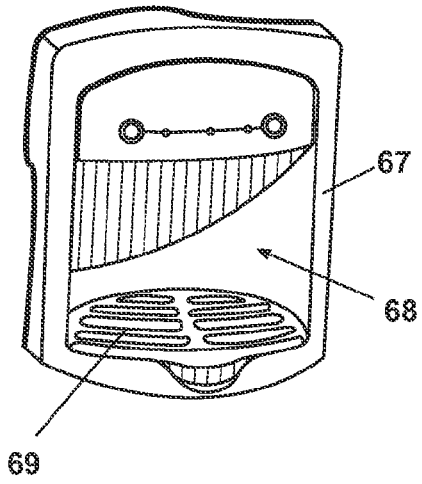
FIG. 10 is a partial perspective view of another embodiment of an ice and water dispenser according to the invention removed from a refrigerator freezer.
Figure 11:
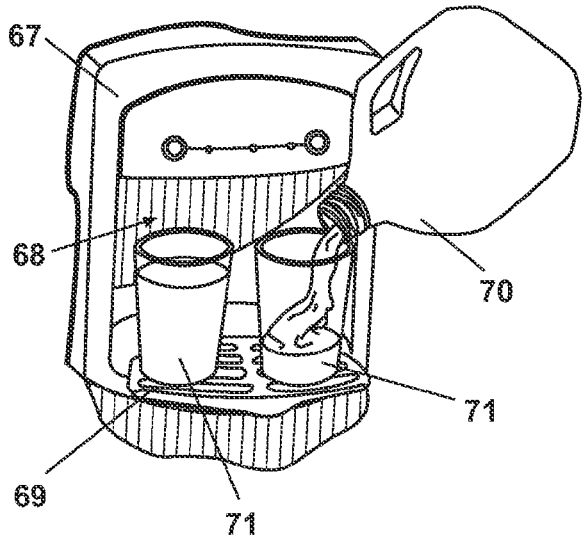
FIG. 11 is a partial perspective view of the ice and water dispenser of FIG. 10 with the container tray extended.

Turning to FIG. 10 and FIG. 11 another movable tray embodiment of the invention can be seen. Dispenser enclosure 68 can have a movable tray 69 carried on the bottom wall of dispenser enclosure 68. Movable tray 69 can be used as an extendable shelf for pouring liquids into glasses 71 or other containers at the refrigerator rather than taking the bottle 70 to another location to fill glasses 71 and then return the bottle to the refrigerator. Bezel 67 can have a suitable track arrangement, not shown, to movably support tray 69 on the bottom wall of dispenser enclosure 68. While not shown in the embodiment of FIG. 10 and FIG. 11, bezel 67 can include a movable spigot as disclosed in one of the several movable spigot embodiments of the invention.

Figure 12:
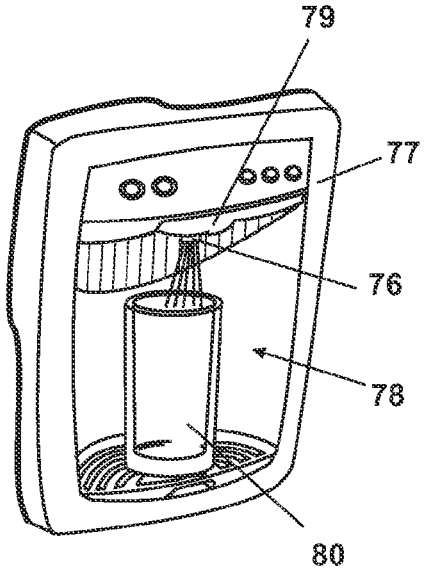
FIG. 12 is a partial perspective view of another embodiment of the ice and water dispenser according to the invention removed from a refrigerator freezer.
Figure 13:
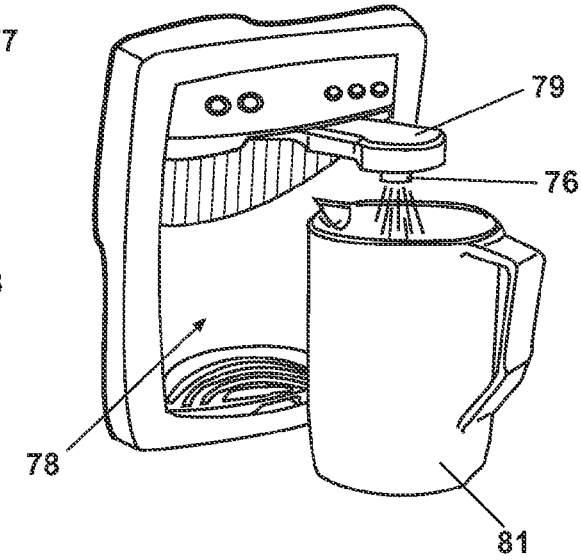
FIG. 13 is a partial perspective view of the ice and water dispenser of FIG. 12 with the spout in the extended position.

Turning to FIG. 12 and FIG. 13 another movable spigot embodiment of the invention can be seen. Dispenser enclosure 78 can include a bottom wall for supporting a container under spigot 79 in its withdrawn position (see FIG. 12). Spigot 79 can be an arm having a pivot point adjacent the face of bezel 77. Thus, when spigot 79 is in its inner dispensing position nozzle 76 is positioned to dispense water into a container positioned in dispenser enclosure 78 such as glass 80. When spigot 79 is rotated outwardly to an extended position, nozzle 76 can be positioned in front of dispenser enclosure 78 to fill a container such as pitcher 81 that can be too large to place in dispensing cavity. In this embodiment spigot 79 can be configured so that nozzle 76 can extend 1" to 6" beyond the face of bezel 77. Those skilled in the art will understand that the dimensions of movable spigot 79 can be adjusted to satisfy the trade-off of the width dispenser enclosure 78 with the extension of spigot 79 beyond the face of bezel 77. While a glass 80 and a pitcher 81 are shown in FIG. 12 and FIG. 13, those skilled in the art will understand that any form of container can by used with the embodiment of FIG. 12 and FIG. 13. Similarly, a movable tray as shown in one of the several movable tray embodiments of the invention can be provided in the dispensing cavity 78. Those skilled in the art will understand that spigot 79 can be provided with a suitable pivot mounting arrangement to bezel 77 that can be similar to the pivotal mounting arrangement shown in the embodiment of FIG. 1 through FIG. 6.

Figure 14:
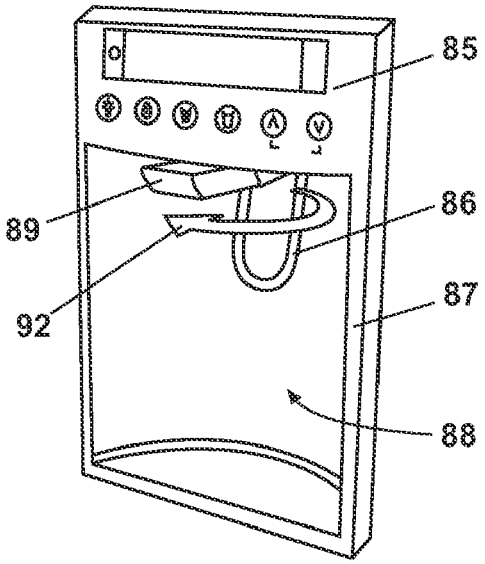
FIG. 14 is a partial perspective view of another embodiment of the ice and water dispenser according to the invention removed from a refrigerator freezer.
Figure 15:
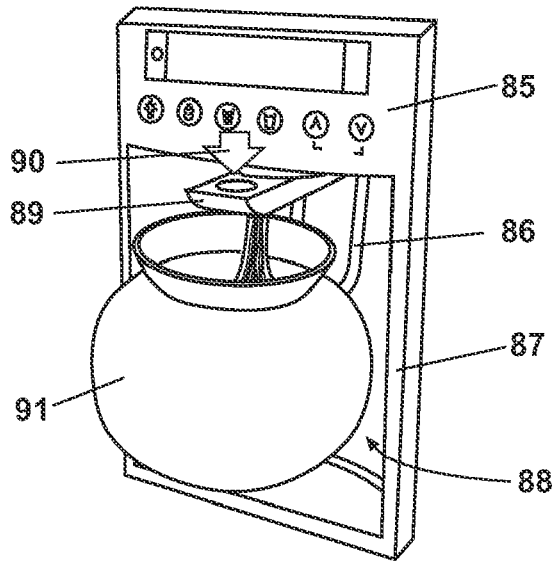
FIG. 15 is a partial perspective view of the ice and water dispenser of FIG. 14 with the spout in the extended position.

Turning to FIG. 14 and FIG. 15, another movable spigot embodiment of the invention can be seen. Bezel 87 can include a dispensing cavity 88 and can include a user interface 85 that can include a water dispenser control such as disclosed in U.S. patent application Ser. No. 10/861,203, now U.S. Pat. No. 7,201,005, referred to above. An actuator 86 can be positioned in dispensing cavity 88 for dispensing ice or water. A spigot 89 can be rotatably mounted at the top of dispensing cavity 88. Spigot 89 can be rotated counterclockwise as indicated by arrow 92 from its inner dispensing position to its extended position. Spigot 89 can be rotatably mounted to bezel 87 about a pivot positioned adjacent the front of bezel 87 to allow spigot 89 to extend outwardly from the dispensing cavity as shown in FIG. 15. The pivotal mounting arrangement for spigot 89, not shown, can be similar to the pivotal mounting arrangement for spigot 19 as shown in FIG. 1 through FIG. 6. In this embodiment spigot 89 can be configured so that the nozzle, not shown, can extend 1" to 2¼" beyond the face of bezel 87. Those skilled in the art will understand that the dimensions of movable spigot 89 can be adjusted to satisfy the trade-off of the width dispensing cavity 88 with the extension of spigot 89 beyond the face of bezel 87. Further, the pivotal mounting arrangement for spigot 89 can include a switch actuator for operating the water dispensing control, not shown, when the front end of spigot 89 is pressed down as indicated by arrow 90 to dispense water into a container 91. A switch, not shown, can be actuated by pressing on the end of spigot 89 can be in addition to a switch, not shown, that can be actuated when actuator 86 is pressed. An advantage of providing an alternate actuating arrangement for the water dispenser is the ability to fill containers too large to fit into dispensing cavity 88 to operate actuator 86.

Figure 16:
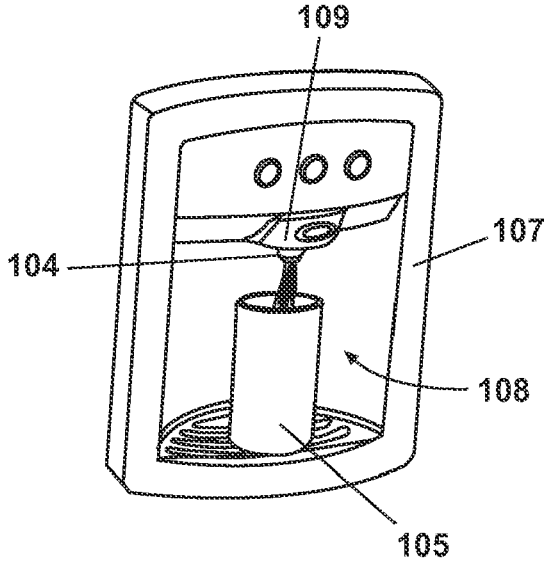
FIG. 16 is a partial perspective view of another embodiment of a water dispenser according to the invention removed from a refrigerator freezer.
Figure 17:
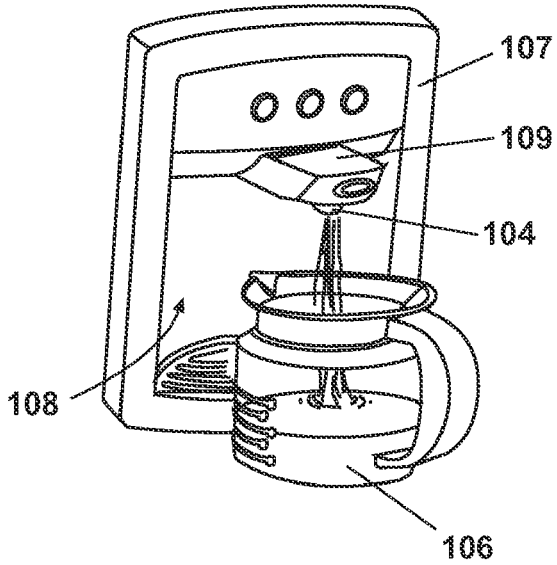
FIG. 17 is a partial perspective view of the water dispenser of FIG. 16 with the spout in the extended position.

Turning to FIG. 16 and FIG. 17 another movable spigot embodiment of the invention can be seen. Bezel 107 can include a dispensing cavity 108. An extendable spigot 109 can be mounted in the top of dispensing cavity 108 for movement between an inner dispensing position (FIG. 16) and an extended position (FIG. 17) for filling a large container such as pitcher 106. In this embodiment spigot 109 can be configured so that nozzle 104 can extend 1" to 6" beyond the face of bezel 107. Those skilled in the art will understand that the dimensions of movable spigot 109 can be adjusted to satisfy the trade-off of the depth of dispensing cavity 108 with the extension of spigot 109 beyond the face of bezel 107. Nozzle 104 can include flow straightening enhancements as discussed above, or can include a screen, an aerator and/or an enlarged flow passage to slow the flow of water through the nozzle, all not shown. Spigot 109 can be slideably carried on a track, not shown, mounted to bezel 107 and can include a supply end opposite nozzle 104. Supply end, not shown, can be connected to the refrigerator water supply with a linearly extendable supply line, not shown. The connection of the refrigerator water supply to the supply end of spigot 109, not shown, can alternately include a swivel interface arranged to allow spigot 109 to be moved between its inner and outer dispensing positions. Alternately, the supply line from the refrigerator water supply can include an extra length of tubing, not shown, coiled tubing, not shown, slip joint connection, not shown, or a bellows, not shown, as are well known arrangements for connecting the movable spigot supply end to the refrigerator water supply.

Figure 18:
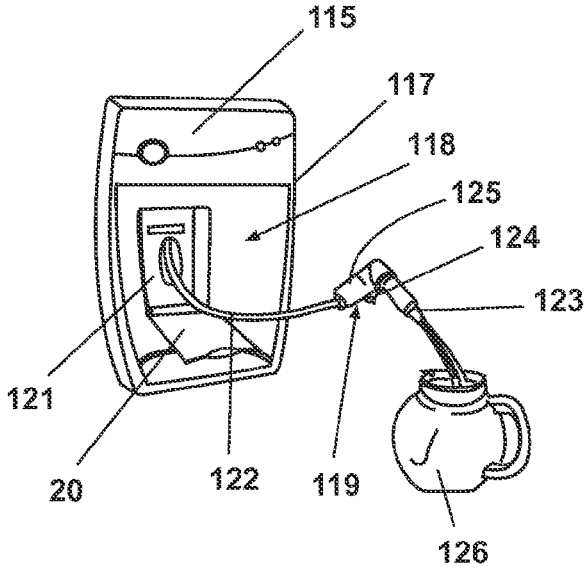
FIG. 18 is a partial perspective view of another embodiment of a water dispenser according to the invention removed from a refrigerator freezer.

Turning to FIG. 18 another embodiment of the invention can be seen. Bezel 117 can include a dispensing cavity 118 that can include a recess 121 for storing a water wand 119 having a supply hose 122. Recess 121 can be closed when the water wand is retracted into recess 121 with a door 120. Bezel 117 can include a user interface 115 and can include a fixed or movable spigot, not shown, for dispensing water into a container positioned in dispensing cavity 118. Water wand 119 can include a nozzle 123 and a grip 125. Grip 125 can include an actuator 124 that can operate a mechanical or electrical valve to open the water line so water can flow through nozzle 123 into a container 126 to be filled. Supply hose 122 can be any desired length and can be long enough to fill containers positioned on an adjacent work surface or even on the floor such as a pet water dish or large cooler. A water wand, not shown, can be configured so that when the water wand is retracted into dispensing cavity 118 the nozzle is positioned at the top of dispensing cavity 118 to dispense water into a container positioned in dispensing cavity 118 in lieu of a movable spigot in the top of dispensing cavity 118.

Figure 19:
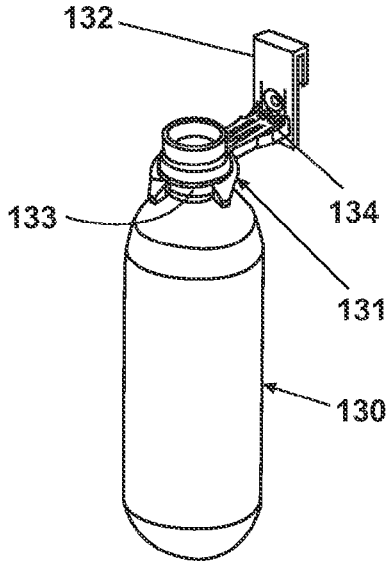
FIG. 19 is a partial perspective view of a water bottle and hanger attachment for use with an ice and water dispenser according to the invention.
Figure 20:
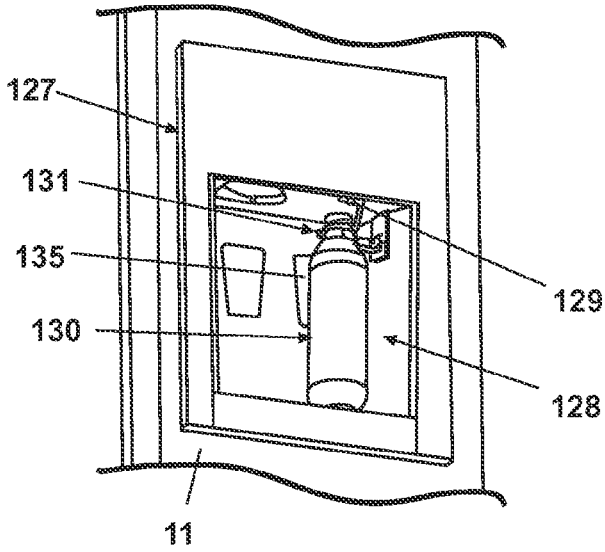
FIG. 20 is a partial perspective view of an ice and water dispenser according to the invention removed from a refrigerator freezer and incorporating the water bottle and hanger attachment of FIG. 19.

Turning to FIG. 19 and FIG. 20 a bracket for holding a water bottle in position for filling can be seen. Bezel 127 can include a dispensing cavity 128 that can include a spigot 129. A water bottle 130 can be held in position under spigot 129 by a bracket 132 having fingers 131 that can snap around neck 133 of water bottle 130. Fingers 131 can be hinged to bracket 132 by hinge pin 134 so that fingers 131 can be folded up or down so as not to interfere with filling of other containers. A bracket as shown in FIG. 19 and FIG. 20 can be particularly useful for filling sports water bottles that can have rounded bottoms. Bezel 127 can include a user interface, not shown, as disclosed in patent application Ser. No. 10/861,203, now U.S. Pat. No. 7,201,005, referred to above that can include a Press to Fill touch pad on the user interface instead of, or in addition to, a paddle 135 for actuating the water dispenser for filling a water bottle or other container.

Figure 21:
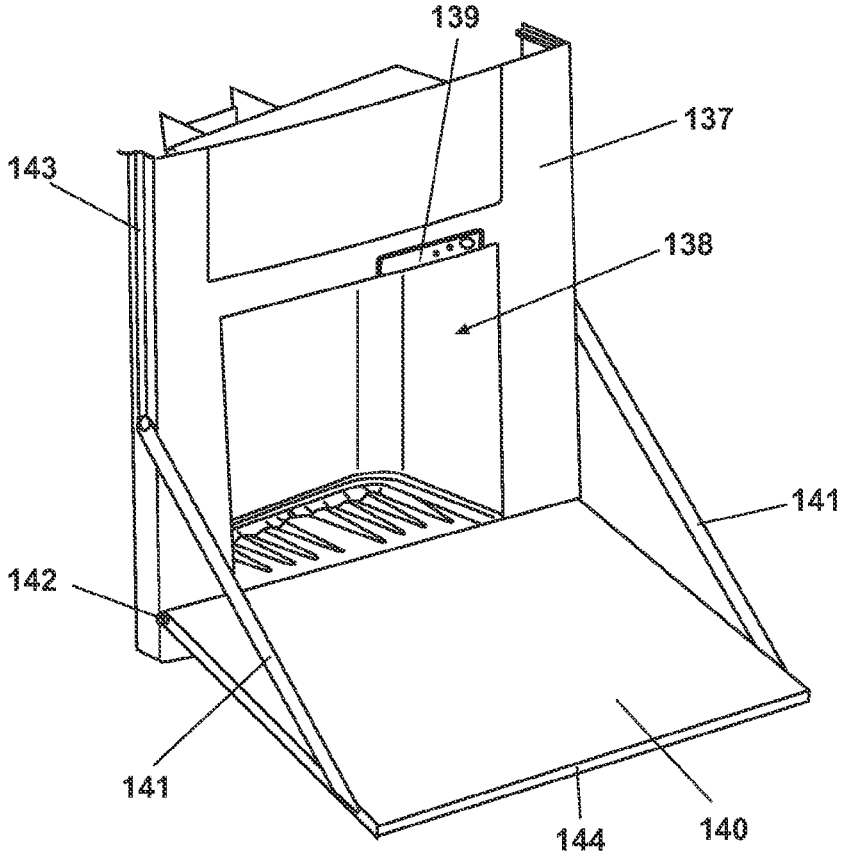
FIG. 21 is a partial perspective view of another embodiment of ice and water dispenser according to the invention removed from a refrigerator freezer and having a fold down tray.
Figure 22:
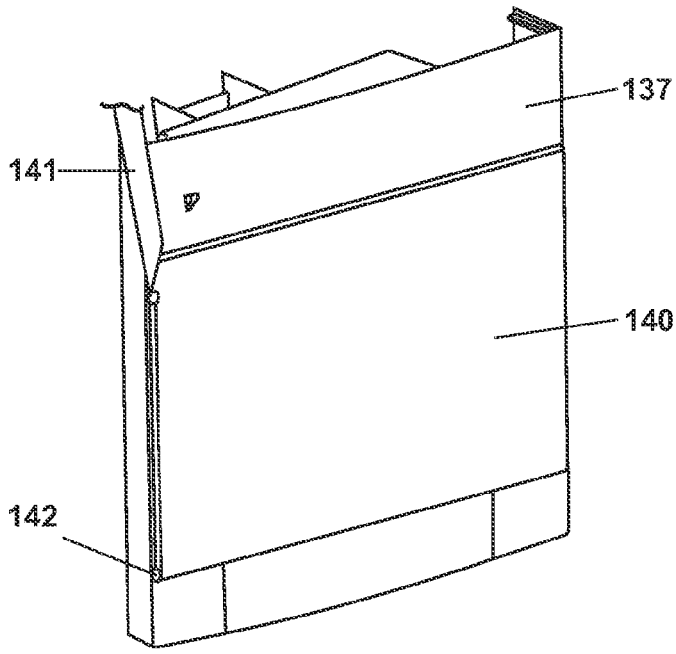
FIG. 22 is a partial perspective view of the ice and water dispenser of FIG. 21 with the tray folded up.

Turning to FIG. 21 and FIG. 22 another movable tray embodiment of the invention can be seen. Bezel 137 can have a dispensing cavity 138 and a movable spigot 139. Bezel 137 can have a tray 140 pivotally mounted to the face of the bezel by hinges 142. Tray 140 can be held in a horizontal position extending outward from the bottom of dispensing cavity 138 by supports 141 that can be pivotally connected to tray 140 adjacent edge 144 and can be slideably carried in tracks 143 in the side walls of bezel 137. Those skilled in the art will understand that supports 141 can be replaced by other known support arrangements to movable support tray 140 in the horizontal position for filling containers with ice or water, or for holding food or containers be taken from or placed in the refrigerator or for filling containers with liquid from a bottle stored in the refrigerator as shown in FIG. 11. Likewise those skilled in the art will understand that tray 140 can be arranged to fold down when not in use rather than fold up as illustrated in FIG. 22.

While the invention has been specifically described in connection with certain specific embodiments thereof, it is to be understood that this is by way of illustration and not of limitation, and the scope of the appended claims should be construed as broadly as the prior art will permit.

We claim:

1. A water dispenser for a refrigerator freezer comprising:

a dispenser housing adapted to be mounted on a door of the refrigerator freezer;

a dispensing cavity in the dispenser housing;

a spigot movably mounted in the dispensing cavity for movement between an inner dispensing position in the dispensing cavity for dispensing water into a container positioned in the dispensing cavity, and an outer dispensing position for dispensing water into a container positioned front of the dispensing cavity wherein the vertical position of the spigot is maintained in both the inner dispensing position and the outer dispensing position.

2. The water dispenser of claim 1 wherein the spigot is movable to one or more positions between the inner dispensing position and the outer dispensing position for dispensing water into a container positioned in or in front of the dispensing cavity.

3. The water dispenser of claim 1 further including a spigot shroud having a top wall and sidewall formed integrally with the spigot.

4. The water dispenser of claim 1 further including a spigot shroud having a top wall and sidewall positioned over and movable with the spigot.

5. The water dispenser of claim 1 further including a spigot shroud having a top wall and sidewall positioned over and movable with the spigot, and wherein a portion of the shroud engages a portion of the spigot to form a fluid enclosure.

6. The water dispenser of claim 1 wherein the spigot is rotatably mounted in the upper portion of the dispensing cavity such that the spigot is rotated from the inner dispensing position to the outer dispensing position.

7. The water dispenser of claim 1 wherein the spigot is pivotally mounted in the upper portion of the dispensing chamber and wherein the spigot has a dispensing end spaced from a pivot end whereby when the spigot is in the inner dispensing position the dispensing end is positioned in the dispensing cavity and when the spigot is pivoted to the outer dispensing position the dispensing end is positioned outwardly from the pivot end and is outside the dispensing cavity.

8. The water dispenser of claim 7 wherein the spigot is positioned at the front of the dispensing cavity substantially in line with the pivot end in the inner dispensing position.

9. The water dispenser of claim 1 wherein the spigot is slideably mounted in the upper portion of the dispensing cavity such that the spigot slides from the inner dispensing position to the outer dispensing position.

10. The water dispenser of claim 9 wherein the spigot has a dispensing end and a supply end for connecting the spigot to a water supply line for the dispenser.

11. The water dispenser of claim 10 wherein the connection of the supply end of the spigot to the water supply is arranged to permit movement of the spigot from the inner dispensing position to the outer dispensing position.

12. The water dispenser of claim 11 wherein the connection of the supply end of the spigot to the water supply includes a linearly extendable portion to allow the spigot to be extended to the outer dispensing position.

13. The water dispenser of claim 11 wherein the connection of the supply end of the spigot to the water supply includes a swivel interface to allow the spigot to be extended to the outer dispensing position.

14. The water dispenser of claim 11 wherein the connection of the supply end of the spigot to the water supply includes extra tubing to allow the spigot to be extended to the outer dispensing position.

15. The water dispenser of claim 14 wherein the extra tubing is coiled to take up extra tubing when the spigot is positioned inwardly from the outer dispensing position.

16. The water dispenser of claim 11 wherein the connection of the supply end of the spigot to the water supply includes a bellows to allow the spigot to be extended to the outer dispensing position.

17. The water dispenser of claim 9 further including a track for slideably supporting the spigot in the dispenser housing with the dispensing end in the inner dispensing position when the spigot is retracted and in the outer dispensing position when the spigot is extended.

18. A water dispenser for a refrigerator freezer comprising: a dispenser housing adapted to be mounted on a door of the refrigerator freezer; a dispensing cavity in the dispenser housing; a spigot movably mounted in the dispensing cavity for movement between: a first dispensing position in the dispensing cavity for dispensing water into a container positioned in the dispensing cavity; and at least a second dispensing position for dispensing water into a container in the second dispensing position; wherein the vertical position of the spigot is maintained in the first and second dispensing positions.

19. The water dispenser of claim 18, wherein the spigot is movable to one or more positions between the first dispensing position and second dispensing position.

20. The water dispenser of claim 18, wherein the second dispensing position is inside the dispensing cavity.

21. The water dispenser of claim 18, wherein the second dispensing position is outside the dispensing cavity.

* * * * *